United States Patent [19]

Hanna

[11] Patent Number: 4,664,354

[45] Date of Patent: May 12, 1987

[54] REINFORCED INGOT MOLD

[76] Inventor: Glenn W. Hanna, 9611 Emerson Rd., Pittsburgh, Pa. 15235

[21] Appl. No.: 878,189

[22] Filed: Jun. 25, 1986

[51] Int. Cl.[4] ..... B22D 7/06

[52] U.S. Cl. ..... 249/135; 164/DIG. 6; 249/174; 249/205

[58] Field of Search ..... 249/135, 174, 205; 164/DIG. 6

[56] References Cited

FOREIGN PATENT DOCUMENTS

| | | | |
|---|---|---|---|
| 230028 | 11/1963 | Austria | 249/174 |
| 631337 | 8/1963 | Belgium | 249/174 |
| 95515 | 11/1909 | Fed. Rep. of Germany | 249/174 |
| 456742 | 9/1913 | France | 249/174 |
| 53-78928 | 7/1978 | Japan | 249/174 |
| 775438 | 5/1957 | United Kingdom | 249/174 |

*Primary Examiner*—Nicholas P. Godici
*Assistant Examiner*—J. Reed Batten, Jr.
*Attorney, Agent, or Firm*—Walter J. Blenko, Jr.

[57] ABSTRACT

Bosses project from the outer surface of the ingot mold and are arranged in a planar zone, each of the bosses contains a channel that has slidably positioned therein an anchor which is projected beyond the outer surface of each boss into each boss. The projecting portions of the anchors are attached to a continuous reinforcement band extending between the projecting portions of the anchors. The continuous reinforcement band is spaced from the ingot mold. Stresses and strains caused by teeming (pouring) hot molten metal into the ingot mold are absorbed by the continuous reinforcement band.

5 Claims, 3 Drawing Figures

REINFORCED INGOT MOLD

My invention relates to a reinforced ingot mold that is able to withstand greater stresses from thermal effects than ingot molds currently in use. More particularly, this invention relates to providing reinforcing means surrounding the ingot mold.

Cast iron ingot molds are subjected to high stresses due to thermal shock and moments created on the iron walls due to uneven expansion as a result of uneven heating. When molten metal is poured (teemed) into a mold, the temperature difference between the inside wall and the outside wall of the mold can be as much as 2000 degrees Fahrenheit. Such large temperature differentials cause uneven expansion of the mold. The uneven expansion tends to cause cracks in the mold. Those cracks have a tendency to spread through repeated use of the mold. A method for counteracting the tendency of the cracks to spread is by bridging the cracks with a steel plate that is anchored to the mold wall, the forces acting to spread the crack being absorbed by the steel plate. The steel plate applied in such a way provides a ductile material that can resist tension and thus hold the crack together. This method extends the usable life of an ingot mold.

A further known means of extending the usable life of ingot molds is to provide them with steel plates fastened to the outer surface of the ingot mold. The steel plates are fitted tightly to the circumference of the ingot mold and are fixed at prescribed points to the ingot mold walls.

All of the steel plates are joined by fastening means so as to form a continuous band around the entire circumference of the ingot mold. This means of placing the steel band formed by joining the steel plates in direct contact with iron ingot mold wall has some serious disadvantages.

The disadvantage of placing the steel band in contact with the iron mold wall is that thermal conduction from the iron ingot mold wall to the steel plate is maximized. Increased temperatures of the steel plates result in a lowering of their tensile strength, which increases the likelihood of plastic distortion of the steel band made up of the steel plates. This diminishes the effects of the steel plates whose sole purpose is to provide the iron ingot mold with the ductility that the iron lacks.

One method that addresses the above problem is disclosed in Hanna, U.S. Pat. No. 4,351,098. This patent discloses an ingot mold with closely fitted steel plates, the ends of the steel plates forming a continuous band which is attached to the cast iron mold. Spacers are located between the cast iron mold and the continuous band to elevate the band from the cast iron mold wall surface. Anchoring mechanisms attach the continuous band to the ingot mold. Since most of the band is elevated from the ingot mold wall, thermal conductivity is lessened, thus reducing expansion of the band which lessens the tensile forces on the outer wall of the ingot mold.

Hanna, U.S. Pat. No. 4,382,576 provides an ingot mold that involves alteration in the design of the outside surface of the ingot mold. Recesses cast or cut into the outside surface of the ingot mold for the purpose of accommodating steel reinforcement bands are provided. As in Hanna, U.S. Pat. No. 4,351,098 discussed above, these recesses provide air spaces between the mold surface and the steel reinforcement bands. This design reduces thermal conduction from the ingot mold to the steel reinforcement bands and bridges any irregularities in the iron mold surface. In addition, the steel reinforcement bands are applied so that the bands do not extend beyond the furthest outside surface of the ingot mold exterior wall. That construction protects the steel reinforcement bands from abuse that may occur from handling the mold and from molten steel that may splash from the top of the mold during teeming or transportation. It has been found, however, that the bands are overstressed by expansion of the mold due to heating.

The above designs have been improvements over conventional ingot molds, but have still left some problems unsolved. Specifically, the problem of cracking still exists. This is because the combination of the inner wall of the ingot mold expanding more than the outer wall of the ingot mold causes the inner wall to be in compression and the outer wall to be in tension. After repeated uses of conventional ingot molds, the tensile forces eventually cause the outer wall of the ingot mold to crack. The wall of the mold is weakened where a crack occurs, and repeated heating cycles cause stress concentrations adjacent to the crack, leading to further cracking. The crack may be propagated through the entire mold wall by repeated heating and cooling cycles, leading to deterioration of the mold and ultimate scrapping.

I provide a reinforced ingot mold with a plurality of bosses projecting from the surface of the ingot mold. I further provide that each of these bosses have a channel that extends from the outer surface of the boss into each boss. The bosses are arranged in a planar zone. Anchor means are placed in each channel for sliding movement in and out of each channel. A portion of each anchor means projects beyond the surface of the ingot mold, the projecting portions of the several anchor means being joined to a continuous steel band. The projecting portions are attached to the continuous steel band.

When molten steel is teemed into the reinforced ingot mold, the reinforced ingot mold will expand and will force the anchor means to expand along with the tension means. This action transfers the tensile forces that would have been on the outer wall of the reinforced ingot mold to the tension means. Lower tensile forces on the outer wall of the reinforced ingot mold cause the reinforced ingot mold to be less prone to cracking, thus increasing its useful life.

In the accompanying drawings, I have illustrated a present preferred embodiment of my invention, in which FIG. 1 is a side elevational view of an ingot mold embodying my invention.

Figure 1:
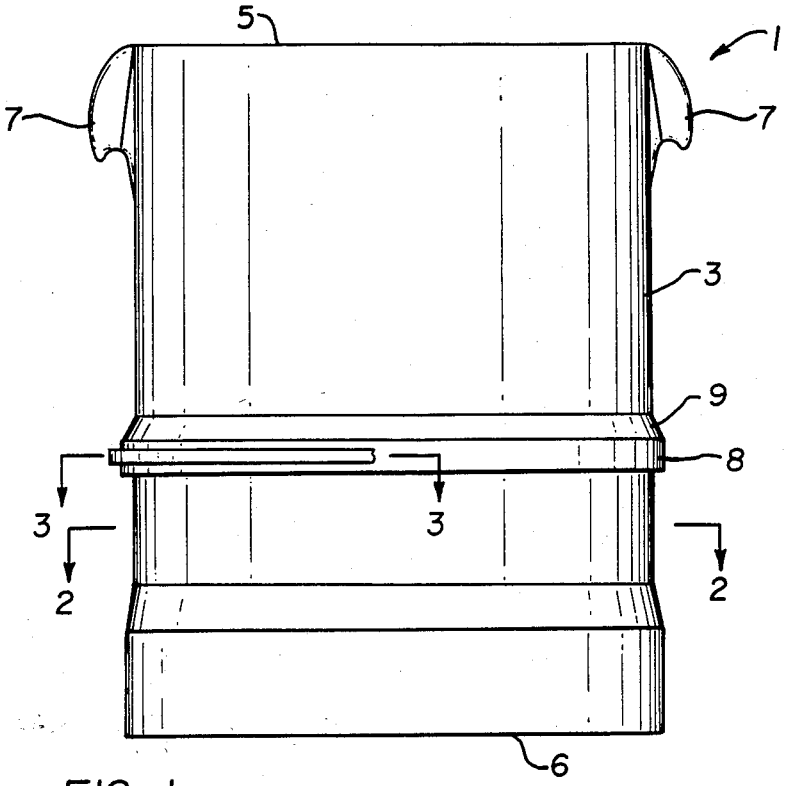
Figure 2:
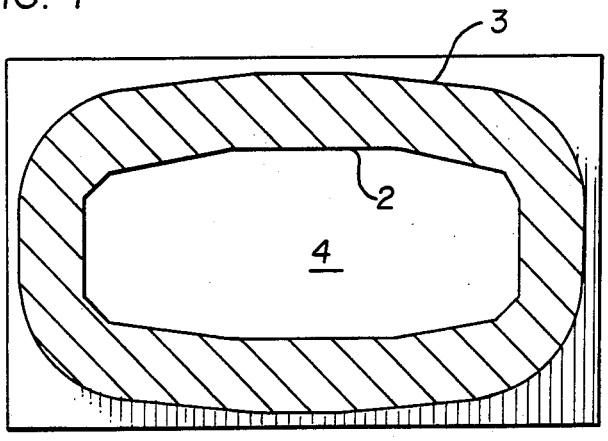
FIG. 2 is a cross-sectional view taken along line 2—2 in FIG. 1.

Referring more particularly to FIG. 1, there is shown a typical embodiment of the reinforced ingot mold 1. The reinforced ingot mold 1 is approximately oval shaped with an inner wall 2 and an outer wall 3. The reinforced ingot mold 1 forms a hollow cylindrical cavity 4 with open ends on the top 5 and the bottom 6. The reinforced ingot mold 1 is placed on a railroad car, the platform of which provides a base so that molten metal can be teemed into the reinforced ingot mold 1. The reinforced ingot mold 1 is equipped with hooks 7 to facilitate stripping of the mold from the ingot.

The reinforced ingot mold 1 is formed with bosses 8 that project outwardly from the reinforced ingot mold 1. These bosses 8 are arranged in a planar zone 9 which is parallel to the base and located approximately at a midpoint between the top and the base of the reinforced ingot mold 1. The bosses 8 are made of the same material as the reinforced ingot mold 1 and are preferably located on the most rounded edges of the outer wall 3 of the reinforced ingot mold 1. There are preferably four bosses 8 located in the planar zone 9.

Figure 3:
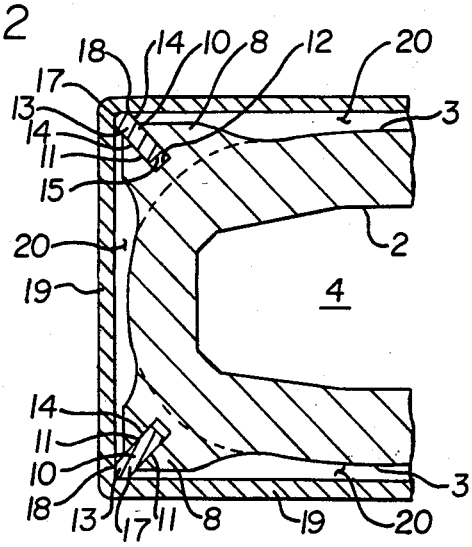
FIG. 3 is a partial cross sectional view taken along line 3—3 in FIG. 1.

Referring more particularly to FIG. 3, each boss 8 contains channel means 10 which extends from the outer wall 3 of each boss 8 into each boss 8. Preferably, the channel means 10 are rectangularly shaped having two long side walls 11 and one short base wall 12. The length of the long side walls 11 is approximately three times the length of the short base wall 12.

Anchor means 13 are positioned in the channel means 10. Anchor means 13 are preferably parallelepipedal, with rectangular bases having two longer sides 14 and two shorter sides 15. The height 17 of the anchor means is approximately one half the measurement of the shorter side 15. The anchor means 13 are positioned in the channel means 10 so that the longer sides 14 are frictionally engaged against the long side walls 11 of the channel means. The anchor means 13 can move in and out of the channel means 10. Each anchor means 13 is also positioned so that a portion 17 of the anchor means projects outwardly from the surface of the reinforced ingot mold 1. The anchor means are preferably constructed of a low carbon steel.

The projecting portion 17 of the anchor means 13 is weldedly attached at 18 to a tension means 19. The tension means 19 extends between all the projecting portions 17 of the anchor means 13. Because of this connection, the tension means 17 is elevated from the surface of the reinforced ingot mold 1, leaving a space 20 between the tension means 19 and the reinforced ingot mold 1. The tension means 19 is preferably constructed of a low carbon steel.

In use, teeming the hot molten metal into the reinforced ingot mold 1 will cause the reinforced ingot mold 1 to expand. Expansion of the reinforced ingot mold 1 causes the distance between the bosses 8 to increase. The increase in distance between bosses 8 will cause the distance between the anchor means 13 to increase. This expansion will cause tensile forces to be applied to the tension means 19 through the anchor means 13. This action will reduce the tensile forces exerted on the outer wall 3 of the reinforced ingot mold 1. Further increases in the tensile forces on the tension means 19 will also tend to move the anchor means 13 deeper into the channel means 10, overcoming frictional forces between the anchor means 13 and the two long side walls 11 of the channel means 10. In that manner, the tensile forces applied to the tension means 19 are limited and will not exceed a safe working limit. At the same time, the tensile forces in the outer wall 3 of the reinforced ingot mold 1 are reduced by the tension means 19. This reduction of tensile forces in the outer wall 3 of the reinforced ingot mold 1 prevents cracking of the outer wall 3 which increases the useful life of the reinforced ingot mold 1.

While I have illustrated and described a present preferred embodiment of the invention, it is to be understood that the invention is not limited thereto and may be otherwise variously practiced within the scope of the following claims.

I claim:

1. An ingot mold comprising a plurality of bosses projecting from the outer surface of said ingot mold;

said bosses arranged in a planar zone;

each of said bosses having channel means extending from the outer surface of each boss into each boss;

said channel means having anchor means slidably positioned therein for movement of the anchor means into and out of the channel means;

said anchor means having a portion projecting outwardly beyond the surface of each boss; and tension means attached to and extending between the projecting portions of the anchor means, whereby the tension means extend between projecting portions of the anchor means and are spaced from the surface of the ingot mold.

2. The ingot mold of claim 1 wherein said anchor means is made of low carbon steel.

3. The ingot mold of claim 2 wherein said tension means is continuous and surrounds the ingot mold.

4. The ingot mold of claim 3 wherein said tension means is made of low carbon steel.

5. An ingot mold having vertically extending walls which form a perimeter around a cavity for receiving molten metal the improvement comprising a plurality of bosses located in a planar zone and projecting from the outer surface of the ingot mold, each boss having channel means extending from the outer surface of each boss into each boss, the channel means having anchor means slidably positioned therein for movement into and out of the channel means, each anchor means having a portion projecting outwardly beyond the surface of each boss and a tension means attached to and extending between the projecting portions of the anchor means whereby the tension means extend between projecting portions of the anchor means and are spaced from the surface of the ingot mold.

* * * * *